US006539770B2

(12) United States Patent
Olsson

(10) Patent No.: US 6,539,770 B2
(45) Date of Patent: Apr. 1, 2003

(54) DENT PULLING APPARATUS AND SYSTEM

(76) Inventor: Goran K. Olsson, 926 S. Andreasen Dr., Ste. 101, Escondido, CA (US) 92029

( * ) Notice: Subject to any disclaimer, the term of this patent is extended or adjusted under 35 U.S.C. 154(b) by 0 days.

(21) Appl. No.: 09/863,203

(22) Filed: May 22, 2001

(65) Prior Publication Data

US 2002/0174704 A1 Nov. 28, 2002

(51) Int. Cl.[7] ..... B21J 13/08
(52) U.S. Cl. ..... 72/458; 72/482.6; 72/705
(58) Field of Search ..... 72/457, 705, 458, 72/479, 482.6, 482.91; 29/402.07; 219/86.21, 98

(56) References Cited

U.S. PATENT DOCUMENTS

| | | | | | |
|---|---|---|---|---|---|
| 3,801,772 | A | * | 4/1974 | Curcio et al. | 72/705 |
| 4,376,385 | A | * | 3/1983 | Davis | 72/479 |
| 5,333,486 | A | * | 8/1994 | Ishihara | 72/391.2 |
| 5,546,786 | A | * | 8/1996 | Fugel | 72/457 |
| 5,808,262 | A | * | 9/1998 | Mukherjee | 219/69.12 |
| 5,918,501 | A | * | 7/1999 | Sunaga et al. | 72/479 |

* cited by examiner

*Primary Examiner*—Ed Tolan
(74) *Attorney, Agent, or Firm*—Donn K. Harms

(57) ABSTRACT

A hand held dent pulling device for attachment to and use in combination with a MIG or similar welder. The device features a elongated body member with an axial cavity and a face plate mount at a front end. An elongated shaft slidably engages the body member through the axial cavity and is biased toward the face plate. The shaft has an electrode attachment at one end and an attachment for a welder at the opposite end. The elongated shaft is selectively laterally translatable in its mount to the body. The front tip of the electrode is selectively translateable through an aperture through the face plate allowing the user to weld the electrode to the metal body being repaired and to draw the metal toward the face plate by laterally translating the elongated shaft. A handle is provided to grip the device and to translate the shaft once the device is welded to the metal body. Removal from attachment to the body done with a twist of the device snapping off the electrode tip. Optionally a kit of differently configured electrodes and face plates can be used where the user may select the best configured face plate and electrode for the job at hand and mount them to the device for use. The device may also be used with a wire welder and attachable grommet to fix dents in aluminum vehicle bodies and sheet metal.

19 Claims, 3 Drawing Sheets

DENT PULLING APPARATUS AND SYSTEM

BACKGROUND OF THE INVENTION

1. Field of the Invention

The present invention relates to an improved device for pulling dents. More particularly it relates to a device for pulling dents from automobiles and other metallic objects which are prone to dents and surface aberrations. The disclosed device is used in combination with a conventional welder and temporarily attaches to the surface of the metallic auto or other body being repaired at an attachment point at the distal end of an elongated laterally translating rod. Translation of the attached rod pulls the dented surface in the direction of the smooth surface of the body being repaired a user determined distance thereby pulling the dent out. A simple twist of the attached electrode detaches the device from the body. The device features a plurality of face plates each having a different diameter center aperture as well as a plurality of different electrodes of different metals to provide the user a user configurable system of dent pulling for different metallic bodies and different sized dents.

2. Prior Art

Automobiles traverse the highways and byways of most nations on earth and with the millions of drivers and vehicles moving on the roads, collisions are inevitable. The result being dents and other imperfections appearing in the surface of auto and truck bodies from such collisions. Additional indents in the surfaces of autos and trucks can be caused in parking lots from the opening of adjacent vehicle doors which collide with the car in the next stall or from driver error causing the car or truck being driven to encounter road and parking lot hazards such as pipes, rails, and abutments.

Modern vehicles feature a number of improvements over vehicles manufactured earlier in the century in the ever increasing quest to manufacture lighter vehicles to increase gas mileage. One such improvement is the use of ever thinner sheet metal to form the car or truck body. Thinner metal structures inherently dent easier. Another improvement in recent years is the use of alloys of steel that are lighter or aluminum to form the actual body panels. Again, these metals yield the desired weight reduction in the vehicle but are easily dented and hard to repair.

Repair of damaged vehicle surfaces and panels is conventionally performed in auto body repair shops. In prior years, pulling a dent or surface imperfection from a vehicle body panel involved the use of a slap hammer which essentially was a pole with a screw on one end and a large weight slidably located about the outside of the pole. The screw end was screwed through the dented vehicle panel and the weight translated on the pole to a stop on the end opposite the screw. The Resulting force on the stop was translated to the screw and pulled the dent toward the rest of the surface of the vehicle body panel. The holes created in the panel surface and any leftover surface imperfections where then repaired with body repair paste that applied to the panel. As is obvious, this type of repair frequently yielded results worse than the dent itself since the body panel now had a paste applied to the exterior and user-created holes in the surface from the slap hammer.

To avoid the use of such devices and repair paste, sometimes dents in vehicle surfaces can be removed by using specially configured tools to pound on the rear surface of the dent. However, this is a very time consuming procedure due to the limited access to the rear surfaces of dents. Further the results are directly proportional to the skill of the repair person and most dents in double walled vehicle bodies do not yield access to the rear surface which is blocked by the second wall.

Another popular device for removal of surface dents in vehicles operates by temporarily attaching a device to the body panel at the dent. When not actually screwed into the body panel such temporary attachment devices generally weld to the surface.

One such device is depicted in U.S. Pat. No. 5,918,501 (Sunaga) which uses a slap or slide hammer combined with an arc electrode which attaches to the vehicle body surface at the dent. Sunaga however still uses a slide hammer for the force to move the dent and is consequently hard to use since it is hard to calculate the exact amount of force to slide the hammer. Too much force will yield a protrusion in the vehicle body surface when the dent is over pulled or will cause detachment of the electrode.

Another device for removing dents of more modern design is U.S. Pat. No. 5,333,486 (Ishihara). This device features an attachable electrode and handle activated by the user to draw the dent from the surface of the vehicle. However Ishihara is heavy due to its design using many machined parts and is hard to operate with the required manipulation of a plurality of handles along with the need to touch the tip of the tool to the surface and then activate the attached welder while holding the device in place. Further, Ishihara provides no easy manner to adjust the size of the contact surface of the device around the electrode which is necessary when trying to fix the wide variety of shapes and depths of dents in vehicles. Rather, the support legs must be removed and replaced with other such legs in a time-consuming process caused by the design.

Thus, there is a continuing need for improvement in devices used in the field of dent repair and a device that is easily attached to a conventional welder and operated concurrently therewith. Such a device should provide for a plurality of support surfaces around the translating electrode that are easily attached and removed during use to accommodate different sized dents. Such a device should also be inexpensive to manufacture and be lightweight so the operator does not become fatigued by the use of a heave tool. Finally such a device should have an easily adjusted and controlled amount of lateral translation of the attached electrode to allow the user to adjust for the optimum draw of the dent toward the undamaged surface without over drawing the dent.

SUMMARY OF THE INVENTION

The applicant's device is a component interchangeable dent drawing device which features easy attachment to a conventional welder and operation concurrently therewith.

The disclosed device features an easily adjustable laterally translateable electrode that is attached to a vehicle body using the current from a welder attached to the opposite end of the shaft on which the electrode is mounted. Simple adjustment of the amount of lateral translation of the shaft and hence the mounted electrode is achieved using a means of adjustment of electrode translation depicted as a frictionally engaged collar which is tightened to an operating position by a knob. The user thus can easily adjust the amount of lateral translation with the twist of a knob, even while the device is already attached to a vehicle.

Further utility is provided by a plurality of face plates which are easily attached to a mounting face at the electrode end of the body member. The face plates use a removable means of attachment such as pins which cooperatively engage clips on the mounting face to allow the plate to be easily replaced during use of the device.

Additional utility is allowed by the provision of a plurality of electrodes which cooperatively engage with the electrode end of the elongated shaft. Each of the electrodes can vary by shape or by the material encased in an axial bore at the tip to provide the ability to attach to different metals. Using steel inside he axial bore provides the ability to attach the electrode to a steel vehicle body. Using copper in the axial bore provides the ability to heat the surface of the vehicle body and avoid attachment but concurrently smooth the heated body surface more easily. Using aluminum in the axial bore allows for the attachment of an optional grommet to an aluminum body panel which can then be pulled by a separate tool to remove the dent. The device thus can be used on aluminum or steel vehicle bodies to draw or to heat and smooth dents in the surface by simply changing the electrode and adjusting the lateral translation.

It is an object of this invention is to provide a dent pulling device that is easily attachable to steel or aluminum vehicle bodies for removal of dents.

Another objective of this invention is the provision of a dent pulling device that has an easily adjusted amount of lateral translation of the attached device to provide precision in the drawing of dents.

A further objective of this invention is the provision of a dent pulling device that features the easy attachment and replacement of a plurality of face plates with differently configured internal apertures to allow for easy adjustment of the retained body surface around a dent.

Still, another objective of this invention is the provision of a dent pulling device used in combination with a welder, that allows for the easy concurrent activation of the welder when using the disclosed device.

An additional object of this invention is the provision of a lightweight and easily manufactured dent pulling device that is easily attachable to a wide variety of welders used in combination herewith.

Further objectives of this invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF PREFERRED EMBODIMENTS OF THE DISCLOSED DEVICE

Figure 1:
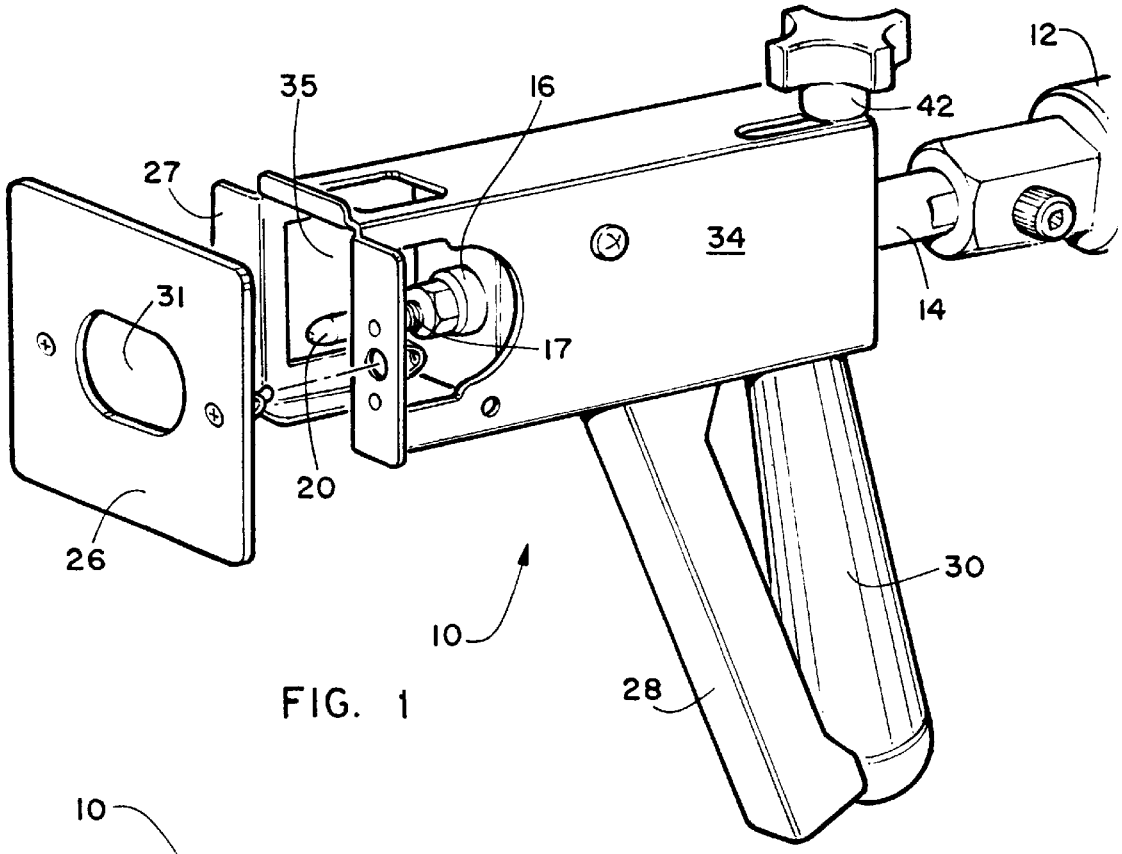
FIG. 1 is a perspective view of the dent pulling device herein disclosed showing the rear attachment of a welder used in combination herewith.
Figure 2:
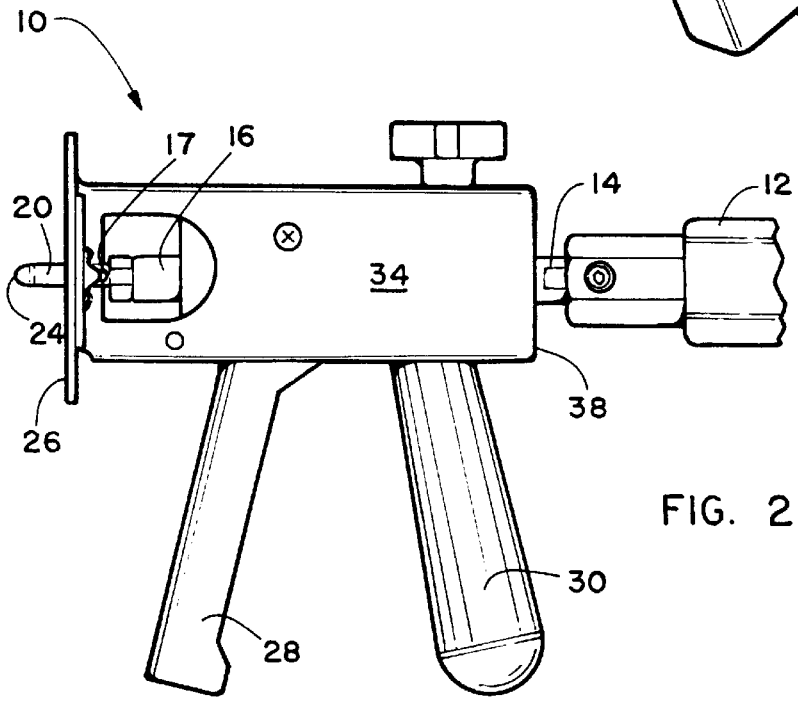
FIG. 2 is a side view of FIG. 1.

Referring now to the drawing FIGS. 1–5 depict views of the device 10 for pulling or drawing dents from vehicle bodies. The device 10 is configured for easy attachment to a conventional MIG or wire or other welder 12 used in combination herewith. Connection of the welder 12 to the device 10 is accomplished by cooperative engagement of the welder 12 at the distal end 14 of the elongated shaft 16.

At the attachment end 18 of the elongated shaft 16 and electrode 20 cooperatively engages the shaft 16 to be removably mounted thereon. Threads 17 on the electrode 20 cooperatively engage similar threads in the elongated shaft 16 in the current best mode. The electrode 20 could be made from steel in cases where it will attach to steel. However, the electrode 20 is currently best made from brass because of the conductive ability of brass and has at front tip 22 which communicates an axial bore 24 with the surface of the front tip 22 and the versatility this configuration provides. In the brass configuration, the axial bore 24 at the front tip 22 allows for the provision of a plurality of electrodes 20 having different metals and characteristics for removable attachment to a plurality of different vehicle body materials. Additionally, if the axial bore 24 is filled with a material that heats instead of affixing to the vehicle body when current is transmitted from the welder 12, the device 10 can be used to heat the body surface for smoothing of dents.

The axial bore 24 if filled with steel material, will inherently attach to the steel body panel of a vehicle. This allows the device to be removably attached to the vehicle body when current from the welder 12 is communicated through the elongated shaft 16 to the electrode 20 and to the material in the axial bore 24. Steel in the axial bore 24 will cause the electrode 20 to weld to the steel body panel due to the heat generated from the current from the welder 12 when the attached welder is activated.

Once attachment of the electrode 20 is accomplished using the welder current, the dent or metal surface 15 is drawn toward the face plate 26 which is mounted to the plate mount 27 on the body member 34. Drawing the metal surface 15 toward the face plate 26 is accomplished by activation of a means to laterally translate the elongated shaft 16. While many configurations might provide a means to laterally translate the elongated shaft by those skilled in the art and such are anticipated, the current best mode features handle 28 in a hinged engagement with the elongated internal member 32 and a fixed rotational engagement with the body member 34 at the upper end using a set screw 37. In this configuration as can be seen, pulling the handle 28 toward the grip 30 by the user, translates the communicating internal member 32 which is dimensioned for slidable engagement inside the axial cavity 35 of the body member 34. Forming the axial cavity 35 of a size to accommodate the outside surface and shape of the internal member 32 provides a track or guide for internal member 32 to laterally translate inside the body member 34. A biasing means such as spring 36 attaches to the rear of the internal member 32 and the slot mounted set screw 37 which engages the body member 34 and thereby urges the internal member 32 toward the plate mount 27 at the front end of the body member 34.

Pulling the handle 28 toward the grip 30 translates the internal member 32 which is hinged to the handle 28 with hinge pin 29 toward the rear end 38 of the body member 34 a determined distance "D" which in turn moves the attached elongated shaft 16 and hence the electrode 20 and tip 22 the same distance D toward the rear end 38. The electrode tip 22 when properly situated in relation to the face plate 26 will move the determined distance D from a first point forward of the face plate to a second point rearward of the face plate 26.

Means for adjustment of the second point of the determined distance D or the maximum rearward point of the electrode tip 22 from the rear of the face plate 26, is provided in the current best mode. This is accomplished by the provision of removable attachment of the exterior of the elongated shaft 16 to the internal member 32 using a collar 40 which is in communicative attachment with the internal member 32. The collar 40 has a thumb screw 42 which when turned, compresses the collar 40 about the circumference of the elongated shaft 16. Thus the thumb screw 42 may be loosened to allow for sliding of the elongated member a distance toward the face plate 26 or toward the rearward of the face plate to thereby adjust the first and more importantly the second point of the determined distance D which the tip 22 of the electrode 20 attached to the elongated shaft 16, will translate when the handle 28 is pulled toward the grip 30. More rearward translation for a large dent and less for a small one needing less draw toward the surface.

Figure 3:
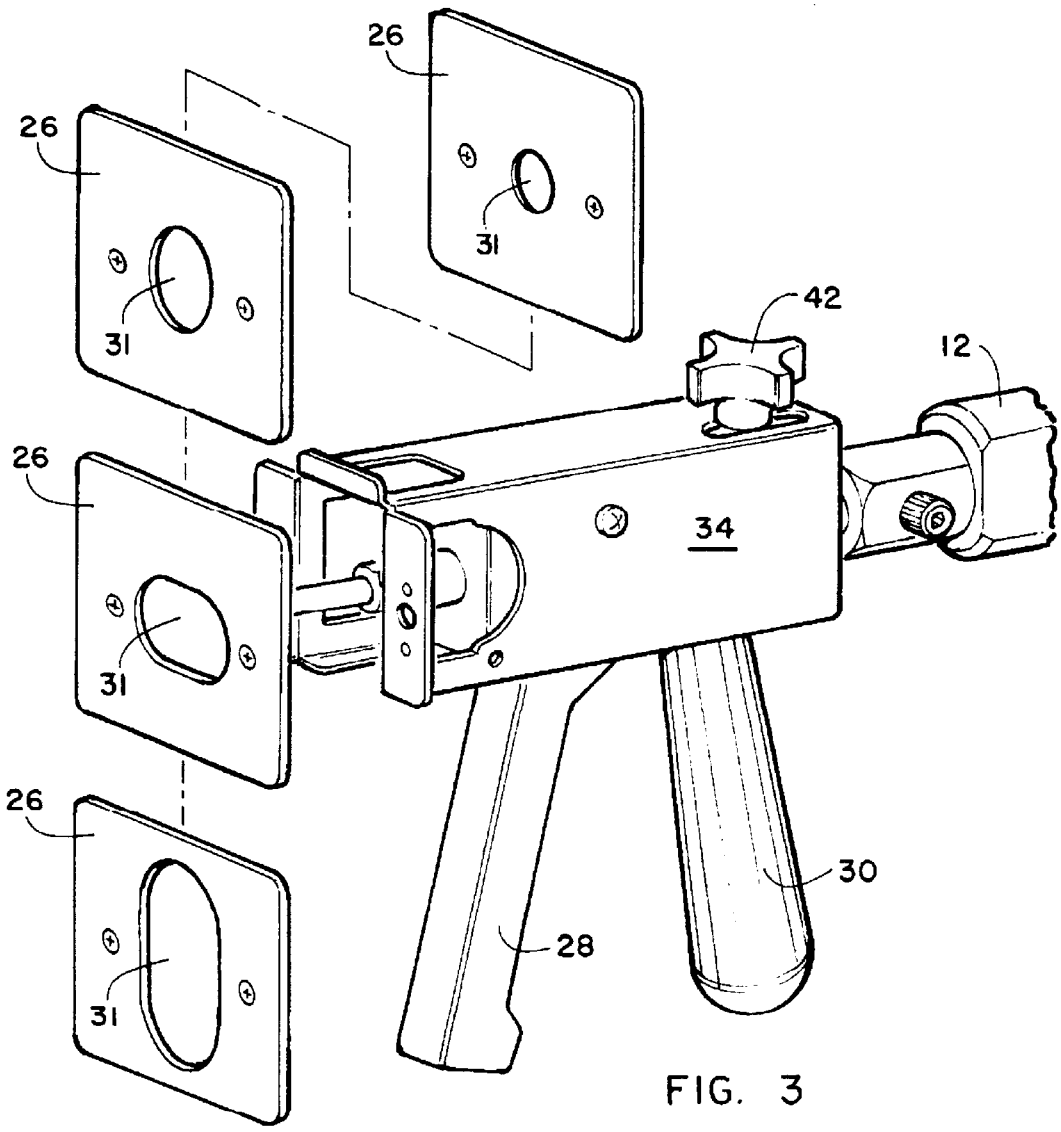
FIG. 3 is a perspective view of disclosed dent pulling device featuring a plurality of different face plates that are removably attachable.
Figure 5:
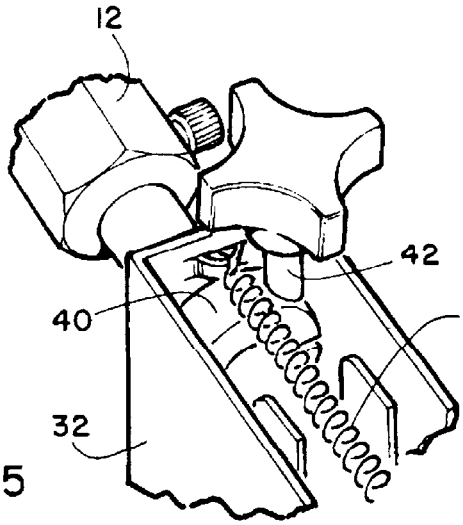
FIG. 5 is a cutaway view of the internally mounted collar provided for adjustment of lateral translation.

Another preferred embodiment would feature a kit having a plurality of face plates 26. Each face plate 26 would removably attach to the plate mount 27 using cooperative attachments 48. Thus each member of the kit would easily attach and detach from the plate mount 27. In the kit form, each of the plurality of face plates 26 would feature a plate aperture 31 dimensioned to accommodate a differently sized dent in the metal being repaired. Thus the user could choose the best face plate 26 from the kit to accommodate and draw the dented metal through the aperture 31. The kit is best depicted in FIG. 3.

In some instances, there would be a need for an electrode 20 which has a front tip 22 that is of a material different from the electrode itself. While a steel tip 22 could be used on most steel surfaces, in the current best mode, the electrode 20 and tip 22 would be made from brass which is an excellent conductor for the current from the welder 12. The tip 22 would have an axial bore 24 therein communicating with the surface of the tip 22. The bore 24 is filled with one or a combination of metals from a group consisting of steel, aluminum, copper, and brass depending on the attachment and heat transfer characteristics desired.

Using the tip 22 made of solid steel or with steel filling the bore 24 will cause the tip 22 to weld and attach to a steel vehicle body when current is applied. Conversely, in cases where attachment is not desired such as smoothing imperfections of an already drawn dent, then an electrode 20 having copper in the axial bore 24 can be used as copper will not attach to steel but will transfer considerable heat developed by the current from the welder 12 to the steel surface making it easier to smooth any imperfections caused by the initial attachment and drawing of the dent.

Figures 4, 6:
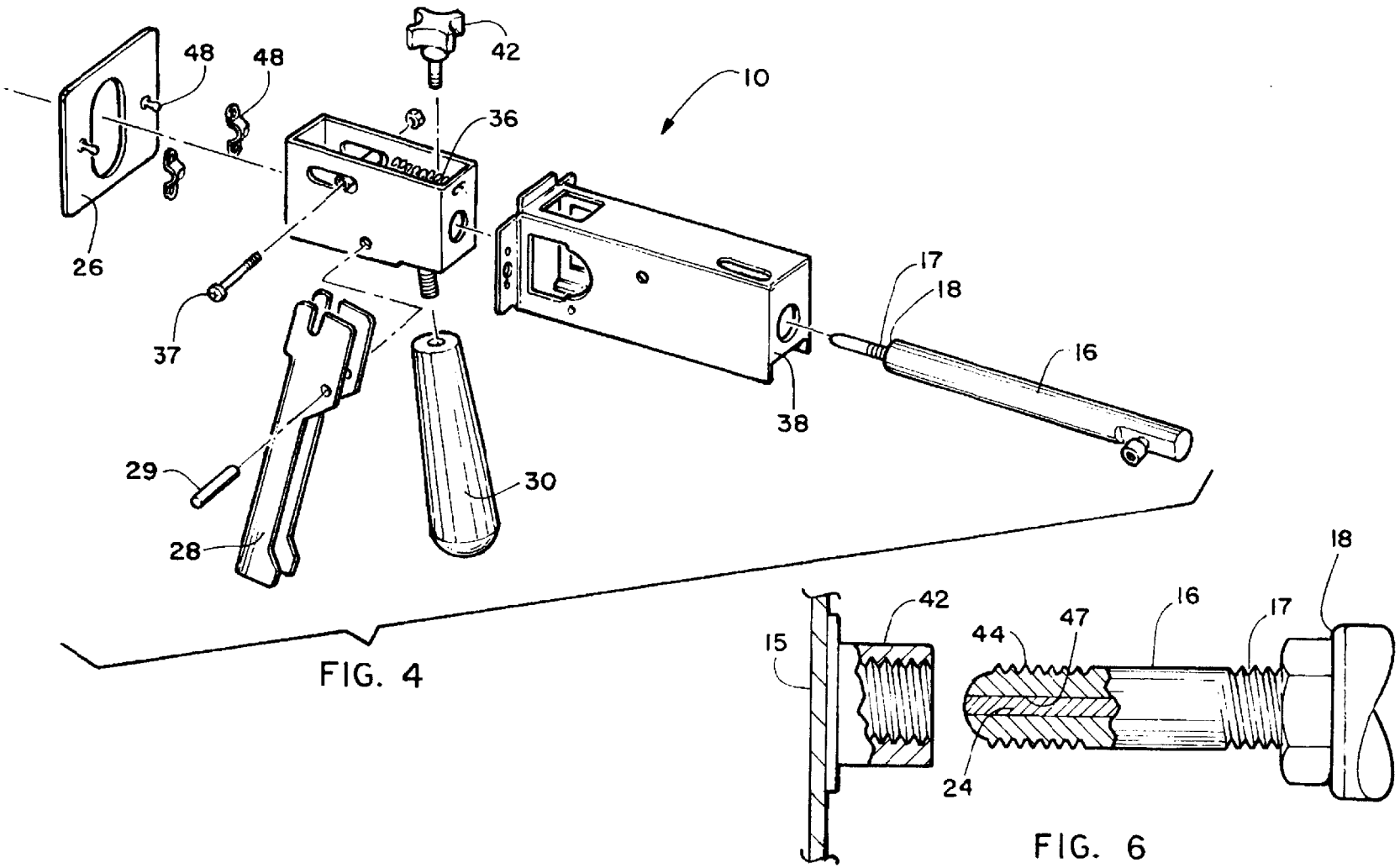
FIG. 4 is an exploded view of the disclosed device.
FIG. 6 depicts an embodiment of the device which attaches a grommet to the metal surface using wire from an attached wire welder.

In cases where aluminum is being fixed the bore may be filled with aluminum for affixation, however aluminum surfaces can be hard to achieve attachment thereon and another preferred embodiment of the disclosed device 10 would be favored in such cases. For repairing aluminum dents the current best mode as depicted in FIG. 6 features an aluminum or similar grommet 42 configured and sized for cooperative engagement with the electrode 20 using threads 44 or snap fittings that would engage similar cooperative engagements on the electrode 20. Other cooperative engagements could be used and are anticipated. In this case, a wire welder would be used and the wire 46 communicated from the welder would travel through an axial passage 48 in the elongated shaft 16. The grommet 42 would be placed on the electrode 20 and then welded to the aluminum or other metal surface 15 using current and wire 46 communicated from the attached welder. Thereafter the metal surface attached to the grommet 42 is drawn toward the rear of the face plate 26 by laterally translating the elongated shaft 16 and the grommet 42 engaged with the electrode 20 toward the second point rearward of the face plate 26. This would be done in the same manner as outlined above.

In another preferred embodiment of the device 10, the electrodes 20 would be provided in a kit form featuring a plurality of electrodes 20 each configured for cooperative attachment o the elongated shaft 16 at one end. Different electrode members of the kit would feature different metals or mixtures of metals from the aforementioned group of metals in the axial bore 24. This would allow the user to simply choose the best electrode for the job at hand and attach it to the device 10. It would also allow for easy replacement during work of broken parts.

While all of the fundamental characteristics and features of the present invention has been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined by the following claims.

What is claimed is:

1. A dent pulling apparatus for use in combination with a welder operatively attached thereto, comprising:

an elongated body member having a front end and a rear end and an axial cavity therein;

a plate mount on said elongated body at said front end;

a face plate affixed to said plate mount, said face plate having an aperture therein communicating between a front surface and a rear surface communicating with said plate mount;

an elongated internal member having a first end, a second end, a central chamber communicating axially therethrough, and having an external surface dimensioned for sizeable engagement within said axial cavity;

said elongated shaft engaged with said elongated internal member through said central chamber, said elongated shaft having an attachment end and having a distal end opposite said attachment end;

biasing means for urging said elongated shaft toward said front end of said elongated body;

means of operative engagement of a welder with said attachment end of said elongated shaft;

an electrode having a front tip cooperatively engaged with said attachment end of said elongated shaft;

said front tip translatable through said aperture in said face plate a determined distance between a first point forward of said front surface of said face plate, to a second point rearward said face plate when said elongated shaft is translated; and means to laterally translate said front tip toward said second point by translating said elongated internal member engaged with said elongated shaft, whereby said front tip may be welded to a metal surface when in said first point and said metal surface drawn toward said second point.

2. The dent pulling apparatus of claim 1 further comprising:

said face plate being removably attachable to said plate mount and being one of a kit of similarly removably attachable face plates each having a differently dimensioned aperture communicating therethrough, whereby the user may choose one of said face plates from said kit with the desired aperture dimension for the dent to be pulled.

3. The dent pulling apparatus of claim 1 further comprising:

means to adjust said second point of said determined distance whereby said front tip of said electrode translates a desired amount of said determined distance rearward of said rear of said face plate.

4. The dent pulling apparatus of claim 2 further comprising:

means to adjust said second point of said determined distance whereby said front tip of said electrode translates a desired amount of said determined distance rearward of said rear of said face plate.

5. The dent pulling apparatus of claim 1 wherein said means to laterally translate said front tip toward said second point by translating said elongated internal member engaged with said elongated shaft comprises:

a handle in hinged engagement with said elongated internal member at a lower end and with an axis pin engaged with said elongated body at an upper end; and a grip engaged with said elongated internal member adjacent to said handle, whereby pulling said handle toward said grip overcomes said biasing means and translates said internal member and said and said elongated shaft.

6. The dent pulling apparatus of claim 2 wherein said means to laterally translate said front tip toward said second point by translating said elongated internal member engaged with said elongated shaft comprises:

a handle in hinged engagement with said elongated internal member at a lower end and with an axis pin engaged with said elongated body at an upper end; and a grip engaged with said elongated internal member adjacent to said handle, whereby pulling said handle toward said grip overcomes said biasing means and translates said internal member and said and said elongated shaft.

7. The dent pulling apparatus of claim 3 wherein said means to laterally translate said front tip toward said second point by translating said elongated internal member engaged with said elongated shaft comprises:

a handle in hinged engagement with said elongated internal member at a lower end and with an axis pin engaged with said elongated body at an upper end; and a grip engaged with said elongated internal member adjacent to said handle, whereby pulling said handle toward said grip overcomes said biasing means and translates said internal member and said and said elongated shaft.

8. The dent pulling apparatus of claim 4 wherein said means to laterally translate said front tip toward said second point by translating said elongated internal member engaged with said elongated shaft comprises:

a handle in hinged engagement with said elongated internal member at a lower end and with an axis pin engaged with said elongated body at an upper end; and a grip engaged with said elongated internal member adjacent to said handle, whereby pulling said handle toward said grip overcomes said biasing means and translates said internal member and said and said elongated shaft.

9. The dent pulling apparatus of claim 7 wherein said means to laterally translate said front tip toward said second point by translating said elongated internal member engaged with said elongated shaft comprises:

a handle in hinged engagement with said elongated internal member at a lower end and with an axis pin engaged with said elongated body at an upper end; and a grip engaged with said elongated internal member adjacent to said handle, whereby pulling said handle toward said grip overcomes said biasing means and translates said internal member and said and said elongated shaft.

10. The dent pulling apparatus of claim 8 wherein said means to laterally translate said front tip toward said second point by translating said elongated internal member engaged with said elongated shaft comprises:

a handle in hinged engagement with said elongated internal member at a lower end and with an axis pin engaged with said elongated body at an upper end; and a grip engaged with said elongated internal member adjacent to said handle, whereby pulling said handle toward said grip overcomes said biasing means and translates said internal member and said and said elongated shaft.

11. The dent pulling apparatus of claim 3 means to adjust said second point of said determined distance comprises:

a compressible collar attached to said elongated internal member in a position to encompass said elongated shaft slidably engaged therethrough;

a collar aperture communicating therethrough sized to slidably engage the circumference of said elongated shaft; and a thumb screw which when tightened compresses said collar aperture about said circumference of said elongated shaft thereby fixing said elongated shafts position relative to said internal member.

12. The dent pulling apparatus of claim 4 means to adjust said second point of said determined distance comprises:

a compressible collar attached to said elongated internal member in a position to encompass said elongated shaft slidably engaged therethrough;

a collar aperture communicating therethrough sized to slidably engage the circumference of said elongated shaft; and a thumb screw which when tightened compresses said collar aperture about said circumference of said elongated shaft thereby fixing said elongated shafts position relative to said internal member.

13. The dent pulling apparatus of claim 7 means to adjust said second point of said determined distance comprises:

a compressible collar attached to said elongated internal member in a position to encompass said elongated shaft slidably engaged therethrough;

a collar aperture communicating therethrough sized to slidably engage the circumference of said elongated shaft; and a thumb screw which when tightened compresses said collar aperture about said circumference of said elongated shaft thereby fixing said elongated shafts position relative to said internal member.

14. The dent pulling apparatus of claim 8 means to adjust said second point of said determined distance comprises:

a compressible collar attached to said elongated internal member in a position to encompass said elongated shaft slidably engaged therethrough;

a collar aperture communicating therethrough sized to slidably engage the circumference of said elongated shaft; and a thumb screw which when tightened compresses said collar aperture about said circumference of said elongated shaft thereby fixing said elongated shafts position relative to said internal member.

15. The dent puling apparatus of claim 1 further comprising:

said electrode comprised of brass and having axial bore communicating with said front tip; and said axial bore filled with one or a combination of metals from a group of metals consisting of steel, copper, aluminum, and brass.

16. The dent puling apparatus of claim 2 further comprising:

said electrode comprised of brass and having axial bore communicating with said front tip; and said axial bore filled with one or a combination of metals from a group of metals consisting of steel, copper, aluminum, and brass.

17. The dent puling apparatus of claim 3 further comprising:

said electrode comprised of brass and having axial bore communicating with said front tip; and said axial bore filled with one or a combination of metals from a group of metals consisting of steel, copper, aluminum, and brass.

18. The dent puling apparatus of claim 1 further comprising:

a kit of said electrodes each having a front tip at a distal end and cooperatively engaged at the opposite end with said attachment end of said elongated shaft; and each member of said kit of said electrodes comprised of brass and having axial bore communicating with said front tip filled with one or a combination of metals from a group of metals consisting of steel, copper, aluminum, and brass, whereby the user may choose one of said kit of said electrodes for use as desired.

19. The dent puling apparatus of claim 2 further comprising:

a kit of said electrodes each having a front tip at a distal end and cooperatively engaged at the opposite end with said attachment end of said elongated shaft; and each member of said kit of said electrodes comprised of brass and having axial bore communicating with said front tip filled with one or a combination of metals from a group of metals consisting of steel, copper, aluminum, and brass, whereby the user may choose one of said kit of said electrodes for use as desired.

* * * * *